United States Patent [19]

Spriewald et al.

[11] Patent Number: 4,987,058

[45] Date of Patent: Jan. 22, 1991

[54] PHOTOGRAPHIC PROCESSING METHOD

[75] Inventors: Erika Spriewald; Gustav Tappe, both of Leverkusen; Heinz Meckl, Bergisch Gladbach, all of Fed. Rep. of Germany

[73] Assignee: Agfa-Gevaert Aktiengesellschaft, Leverkusen, Fed. Rep. of Germany

[21] Appl. No.: 537,942

[22] Filed: Jun. 13, 1990

[30] Foreign Application Priority Data

Jun. 27, 1989 [DE] Fed. Rep. of Germany ..... 3920922

[51] Int. Cl.[5] ..... G03C 7/00; G03C 7/42; G03C 5/38

[52] U.S. Cl. ..... 430/372; 430/393; 430/418; 430/428; 430/429; 430/430; 430/460; 430/461; 430/463; 430/490; 430/491

[58] Field of Search ..... 430/372, 393, 418, 430, 430/460, 461, 463, 490, 491, 428, 429

[56] References Cited

U.S. PATENT DOCUMENTS 4,601,975 7/1986 Koboshi et al. ..... 430/393
4,804,616 2/1989 Ueda et al. ..... 430/379

*Primary Examiner*—Paul R. Michl
*Assistant Examiner*—Janis L. Dote
*Attorney, Agent, or Firm*—Connolly & Hutz

[57] ABSTRACT

A processing method without washing gives good photographic properties, without a precipitate being deposited in the stabilizing bath, when the bleach-fixing bath contains a compound of the formula $Fe(X)_2DTPA$, wherein X denotes alkali or ammonium, as bleaching agent, and the stabilizing bath contains a fungicide, HEDP and a hexametaphosphate.

2 Claims, No Drawings

PHOTOGRAPHIC PROCESSING METHOD

The invention relates to a photographic processing method for coloured paper involving the steps of developing, bleach-fixing and stabilising.

The preparation of colour photographic images has hitherto been carried out almost exclusively by large developing institutions which developed the negative films delivered and prepared the coloured photographs using colour negative paper. The advantage of the large developing institutions is, inter alia, that they are well able to take care of the removal of the spent processing solutions produced, in particular the washing water for the final washing. The disadvantage is that the customer often has to wait longer for his prints.

For this reason, small operational units were developed which are installed near to the customer, and the finished prints can be handed to the customer, in the extreme case, as little as one hour after delivering the exposed film. These installations were possible, inter alia, because of the development of a process variant which dispenses with final washing, and instead of this, the developed, bleached and fixed prints were treated with a stabilising solution. The novel installations ("Minilab") therefore manage without a fresh water supply and also produce no waste water. The spent processing solutions are collected in canisters and removed from time to time.

The stabilising solution has the aim of converting the chemicals remaining in the photographs, which originate both from the material itself and from the processing solutions and which are no longer washed away because of the missing washing process, into a form which does not impair the quality of the print, even over a long period.

Bleaching and fixing in Minilabs are conventionally carried out together in one bleach-fixing bath, wherein the iron-ammonium complex salt of ethylenediaminetetraacetic acid ($FeNH_4EDTA$) is a useful bleaching agent and ammonium thiosulphate or sodium thiosulphate are useful fixing agents.

European patent No. 158,369, for example, thus describes a wash-free processing method comprising colour developing, bleach-fixing, stabilising and drying, in which the bleach-fixing solution contains $FeNH_4EDTA$, free EDTA, $(NH_4)_2S_2O_3$ and $(NH_4)_2SO_3$ and the stabilising solution acetic acid, formaldehyde, thiabenzazole, 1-hydroxyethane-1,1-diphosphonic acid (HEDP) and potassium alum.

This combination of bleach-fixing bath and stabilising bath has disadvantages.

Bleach-fixing baths are regenerated in Minilabs using as low as possible a volume per $m^2$.

Hence, an essentially slower exchange of the bath solution results than in the standard case, particularly for Minilabs having relatively low penetration on colour paper. It follows from this that the sulphite in the bath solution is oxidised by the air oxygen, the stability of the thiosulphate is no longer ensured and then a precipitate of sulphur is deposited.

This can be remedied to a large extent if the iron-ammonium salt of diethylenetriaminepentaacetic acid ($Fe(NH_4)_2DTPA$) is used instead of $FeNH_4EDTA$.

The disadvantage of a combination of this advantageous bleach-fixing bath with a subsequent stabilising bath, which contains HEDP, consists in the fact that a precipitate is produced when the stabilising bath is in use. The concentration of DTPA produced by entraining in the stabilising bath cannot prevent this precipitation. It is equally unlikely that precipitation would be prevented using the aminopolycarboxylic acids contained in some stabilising baths in the range from 0.2 to 2 g/l.

It is the aim of the invention to make a system available, in which bleach-fixing bath and stabilising bath are adapted to one another so that the aforementioned disadvantages do not occur and colour photographs of excellent quality—in particular with regard to colour density, residual silver content and stability—are still produced.

This aim is achieved in that a compound of the formula $Fe(X)_2DTPA$, wherein X denotes alkali or ammonium, preferably $Fe(NH_4)_2DTPA$ or $FeNa_2DTPA$, is used as bleaching agent for the bleach-fixing bath, and the stabilising bath contains a fungicide, HEDP and a hexametaphosphate.

The object of the inventIon is therefore a wash-tree method for preparing colour photographs by developing, bleach-fixing, stabilising and drying, characterised in that the bleach-fixing bath contains a compound of the formula $Fe(X)_2DTPA$, wherein X denotes alkali or ammonium, as bleaching agent, and the stabilising bath contains a fungicide, HEDP and a hexametaphosphate.

The bleach-fixing bath preferably contains the bleaching agent in an amount from 0.1 to 0.5 mole/litre. The stabilising bath preferably contains $1\times10^{-3}$ to $5\times10^{-2}$ mole/litre of fungicide, $1\times10^{-3}$ to $5\times10^{-2}$ mole/litre of HEDP and $5\times10^{-4}$ to $5\times10^{-2}$ mole/litre of hexametaphosphate. Examples of suitable fungicides are benzoic acid, sorbic acid and isothazolones.

In principle, this precipitate can be prevented in the stabilising bath by means of complexing agents of all known classes, for example by means of aminopolycarboxylic acids, aminopolyphosphonic acids, citric acid, polymaleic acid or phosphonobutane tricarboxylic acid. However, as most of them hinder the effect of the HEDP conventionally contained in the stabilising bath as an iron masking agent, and hence do not suppress the yellowing produced on tropical storage sufficiently, it has been found, surprisingly, that only the class of phosphoric acids and phosphonic acids remain as suitable compounds, in the optimum case sodium hexametaphosphate.

EXAMPLE

A colour photographic recording material suitable for the processing method of the invention was prepared, by applying the following layers in the sequence given to a substrate on paper coated on both sides with polyethylene. The details of amounts relate in each case to 1 $m^2$. The corresponding amounts of $AgNO_3$ are given for the application of silver halide.

Layer construction

1st layer (substrate layer): 0.2 g of gelatine.

2nd layer (blue-sensitive layer):

blue-sensitive silver halide emulsion (99.5 mole % of chloride, 0.5 mole % of bromide, average particle diameter 0.8 μm) from 0.63 g of $AgNO_3$ with
- 1.38 g of gelatine
- 0.95 g of yellow coupler Y
- 0.29 g of tricresylphosphate (TCP).

3rd layer (protective layer):

1.1 g of gelatine 0.06 g of 2,5-dioctylhydroquinone 0.06 g of dibutylphthalate (DBP).

4th layer (green-sensitive layer):

green-sensitive silver halide emulsion (99.5 mole % of chloride, 0.5 mole % of bromide, average particle diameter 0.6 μm) from 0.45 g of $AgNO_3$ with
1.08 g of gelatine
0.41 g of purple coupler M
0.08 g of 2,5-dioctylhydroquinone
0.34 g of DBP
0.04 g of TCP.

5th layer (UV protective layer):

1.15 g of gelatine 0.6 g of UV absorber of the formula

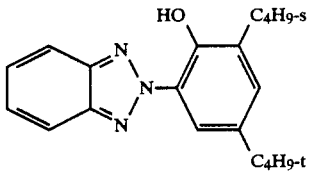

0.045 g of 2,5-dioctylhydroquinone
0.04 g of TCP.

6th layer (red-sensitive layer):

red-sensitised silver halide emulsion (99.5 mole % of chloride, 0.5 mole % of bromide, average particle diameter 0.5 μm) from 0.3 g of $AgNO_3$ with
0.75 g of gelatine
0.36 g of blue-green coupler C
0.36 g of TCP.

7th layer (UV protective layer):

0.35 g of gelatine
0.15 g of UV absorber as for 5th layer
0.2 g of TCP.

8th layer (protective layer):

0.9 g of gelatine
0.3 g of curing agent H of the following formula

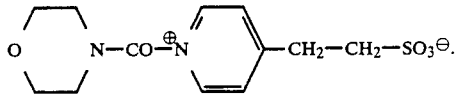

The couplers correspond to the following formulae:

Y

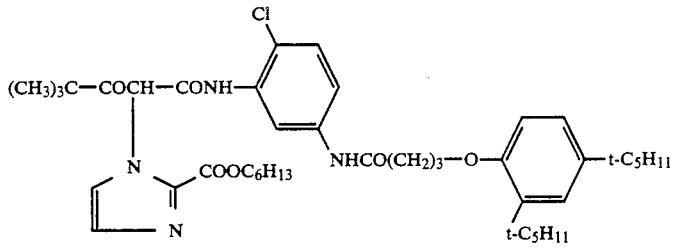

M

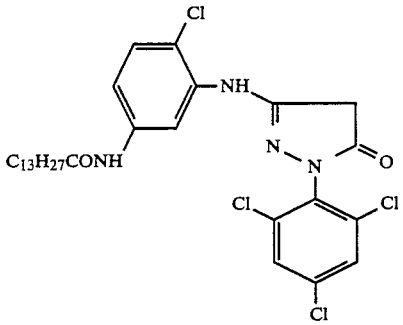

C

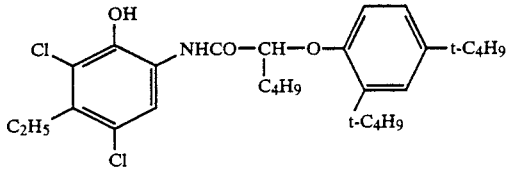

Example 1 (Comparison)

A stepped wedge is exposed on the photographic recording material described above and processed as follows:

| | | |
|---|---|---|
| Developing | 45 seconds | 35° C. |
| Bleach-fixing | 45 seconds | 35° C. |
| Washing | 4-stage counter-current cascade 22.5 seconds for each stage | 30° C. |
| Drying | | |

The individual processing baths had the following composition:

| Developer | |
|---|---|
| Water | 800 ml |
| Ethylenediaminetetraacetic acid (EDTA) | 3.0 g |
| Disodium salt of 4,5-dihydroxy-1,3-benzene-disulphonic acid | 0.3 g |
| Sodium chloride | 2.0 g |
| Triethanolamine | 8.0 g |
| N,N-diethylhydroxylamine, 85 wt. % strength | 5.0 ml |
| 4-(N-Ethyl-N-2-methanesulphonylaminoethyl)-2-methylphenylenediaminesesquisulphate | 5.0 g |

-continued

| | |
|---|---|
| monohydrate (CD3) | |
| Potassium carbonate | 25.0 g |
| maku up to 1 liter with water; pH 10 | |
| Bleach-fixing bath | |
| Water | 800 ml |
| Sodium suphite | 20 g |
| Ammonium thiosulphite | 110 g |
| $Fe(NH_4)_2DTPA$ | 140 g |
| DTPA | 8 g |
| 3-Mercapto-1,2,4-triazole | 1 g |
| Silver chloride | 4 g |
| make up to 1 liter with water and set at pH 5.0. | |

The total water consumption is 2 liters per $m^2$.

The stepped wedges thus obtained are subjected to storage for 7 days at 60° C. and 90% relative humidity. See table for results.

Example 2 (Comparison)

Material according to Example 1 is processed using a wash-free method:

| | | |
|---|---|---|
| Developer | 45 seconds | 35° |
| Bleach-fixing bath | 45 seconds | 35° |
| Stabilising bath | 4-stage counter-current cascade 22.5 seconds for each stage | 35° |
| Drying | | |

Developer and bleach-fixing bath corresponded to Example 1

Composition of stabilising bath A:

| | |
|---|---|
| Water | 800 ml |
| Ethylenediaminetetraacetic acid | 0.5 g |
| Sodium sulphite | 2 g |
| Hydroxyethanediphosphonic acid | 4 g |
| Benzoic acid | 1 g |

make up to 1 litre with water, set at pH 5.0.

Preparation of the use level in the four stabilising bath tanks brought together to form a cascade:

Tank 1 : 800 ml of stabilising bath + 200 ml of bleach-fixing bath

Tank 2 : 960 ml of stabilising bath + 40 ml of bleach-fixing bath

Tank 3 : 992 ml of stabilising bath + 8 ml of bleach-fixing bath

Tank 4 : 998 ml of stabilising bath + 2 ml of bleach-fixing bath.

The consumption of stabilising bath is 250 ml/$m^2$.

The stepped wedges obtained using this process are stored together with the wedges obtained in Example 1. See table for results.

Example 3 (Comparison)

Material and processing with the exception of the stabilising bath corresponds to Example 2.

| Stabilising bath B | |
|---|---|
| Water | 800 ml |
| Ethylenediaminetetraacetic acid | 5 g |
| Sodium sulphite | 2 g |
| Hydroxyethanediphosphonic acid | 4 g |
| Benzoic acid | 1 g |

make up to 1 litre with water and set at pH 5.0.

The use level of the 4 stabilising bath tanks was prepared as in Example 2.

The consumption of stabilising bath corresponds to Example 2.

Storage together with the wedges from Examples 1 and 2 under the conditions mentioned. See table for results.

Example 4 (in accordance with the invention)

Material and processing with the exception of the stabilising bath corresponds to Example 2.

| Stabilising bath C | |
|---|---|
| Water | 800 ml |
| Sodium hexametaphosphate | 2 g |
| Sodium sulphite | 2 g |
| Hydroxyethanediphosphonic acid | 4 g |
| Benzoic acid | 1 g |

make up to 1 litre with water and set at pH 5.0.

The use level of the 4 stabilising bath tanks was prepared as in Example 2.

The consumption of the stabilising bath corresponds to Example 2.

The stepped wedges obtained using this process are stored together with the wedges from Examples 1, 2 and 3 under the conditions mentioned.

Standing test

Samples of the stabilising baths from Examples 2, 3 and 4 were taken from each tank and allowed to stand for 4 days at room temperature. See table for possible occurrence of a precipitate.

TABLE

| | Difference from $D_{min}$ after 7 days at 60° C., 90% relative humidity (× 100) | | | Precipitate after 4 days |
|---|---|---|---|---|
| | yellow | purple | blue-green | standing time |
| Example 1 Washing | 12 | 5 | 1 | — |
| Example 2 Stabilising bath A | 13 | 5 | 1 | Precipitate |
| Example 3 Stablising bath B | 19 | 7 | 2 | No precipitate |
| Example 4 Stablising bath C | 11 | 3 | 0 | No precipitate |

The table shows that in the transition from the processing with washing to a wash-free method, a precipitate occurs in the first stabilising solution tank, which is indeed repressed by increasing the amount of aminopolycarboxylic acid, but that this advantage must be bought with a considerable increase in masking (rise $D_{min}$).

Sodium hexametaphosphate also prevents the formation of precipitate, but in fact additionally ensures a reduction in masking compared to samples washed in the normal manner.

We claim:

1. Wash-free method for preparing colour photographs by developing, bleach-fixing, stabilising and drying, characterised in that the bleach-fixing bath contains a compound of the formula $Fe(X)_2DTPA$, wherein X denotes alkali or ammonium, as bleaching agent, and the stabilising bath contains a fungicide, 1-hydroxyethane-1, 1-diphosphonic acid and a hexametaphosphate.

2. Method according to claim 1, characterised in that $Fe(NH_4)_2DTPA$ or $FeNa_2DTPA$ is used as bleaching agent.

* * * * *